US006383406B1

(12) United States Patent
Huang et al.

(10) Patent No.: US 6,383,406 B1
(45) Date of Patent: May 7, 2002

(54) METHOD FOR PREPARING HIGH CURE TEMPERATURE RARE EARTH IRON COMPOUND MAGNETIC MATERIAL

(75) Inventors: Yuhong Huang; Qiang Wei, both of West Hills; Haixing Zheng, Oak Park, all of CA (US)

(73) Assignee: Chemat Technology, Inc., Northrdige, CA (US)

( * ) Notice: Subject to any disclaimer, the term of this patent is extended or adjusted under 35 U.S.C. 154(b) by 0 days.

(21) Appl. No.: 09/578,563

(22) Filed: May 25, 2000

(51) Int. Cl.[7] ..... H01F 1/00
(52) U.S. Cl. ..... 252/62.51; 148/100
(58) Field of Search ..... 148/100, 301; 252/62.51, 62.54

(56) References Cited

U.S. PATENT DOCUMENTS 5,137,587 A 8/1992 Schultz et al.
5,137,588 A 8/1992 Wecker et al.
5,288,339 A 2/1994 Schnitzke et al.
5,665,177 A 9/1997 Fukuno et al.
5,720,828 A 2/1998 Strom-Olsen
5,788,782 A 8/1998 Kaneko et al.
5,958,283 A * 9/1999 Schmid et al. ..... 252/62.54
5,968,290 A * 10/1999 Sakurada et al. ..... 148/302

OTHER PUBLICATIONS

Burger, Wiegel, Thewalt and Schomburg, Journal of Organometallic Chemistry 87 (1975) 301–309.

* cited by examiner

*Primary Examiner*—Ngoclan Mai
(74) *Attorney, Agent, or Firm*—Thomas I. Rozsa; Tony D. Chen; Jerry Fong

(57) ABSTRACT

Insertion of light elements such as H,C, or N in the $R_2Fe_{17}$ (R=rare earth metal) series has been found to modify the magnetic properties of these compounds, which thus become prospective candidates for high performance permanent magnets. The most spectacular changes are increases of the Curie temperature, $T_c$, of the magnetization, $M_s$, and of coercivity, $H_c$, upon interstitial insertion. A preliminary product having a component R—Fe—C,N phase is produced by a chemical route. Rare earth metal and iron amides are synthesized followed by pyrolysis and sintering in an inert or reduced atmosphere, as a result of which, the R—Fe—C,N phases are formed. Fabrication of sintered rare earth iron nitride and carbonitride bulk magnet is impossible via conventional process due to the limitation of nitridation method.

10 Claims, 2 Drawing Sheets

METHOD FOR PREPARING HIGH CURE TEMPERATURE RARE EARTH IRON COMPOUND MAGNETIC MATERIAL

This invention was made with Government support under contract DE-FG03-93ER81570 awarded by the Department of Energy. The Government has certain rights in this invention.

BACKGROUND OF THE INVENTION

1. Field of the Invention

The present invention generally relates to the field of methods for producing magnetic material based on a substance system comprising a rare-earth element, iron, nitrogen and carbon, and optionally hydrogen. More particularly, the present invention relates to the field of methods for processing high $T_c$ Sm—Fe—N and Sm—Fe—C, N magnetic materials. In particular, the present invention relates to the field of methods for synthesis of magnetic materials by polymerizing, pyrolyzing and sintering amide precursor in an inert or reduced atmosphere.

2. Description of the Prior Art

Ferromagnetic materials and permanent magnets are important materials widely used in electrical and electronic products. The well-established $Nd_2Fe_{14}B$ based magnets have a high saturation magnetization, $m_oM_S$ of 1.6 T, high anisotropy field, $m_oH_A$ of 6.7 T and high energy product, $(BH)_{max}$, of 360 kJ/m$^3$ at room temperature. However, the low Curie temperature, $T_c$, of 310° C. seriously reduces the performance above room temperature.

In recent years, many studies have been conducted on the nitrides and carbides of rare earth iron compounds, and two compounds, $Sm_2Fe_{17}N_{2.3}$ and $Sm_2Fe_{17}C_2$, have been formed with characteristics superior to $Nd_2Fe_{14}B$. For example, the parameters for $Sm_2Fe_{17}N_{2.3}$ are $T_c$=485° C., $m_oM_s$=1.5 T, $m_oH_A$=15 T and for $Sm_2Fe_{17}C_2$ are $T_c$=407° C., $m_oM_s$=1.4 T, $m_oH_A$=13.9 T. These parameters imply that magnets made from these alloys could have an energy product as high as 470 kJ/m$^3$, with a superior $T_c$.

However, the a-Fe precipitated during the nitridation of Sm—Fe alloy is found to reduce the performance of hard magnets. Furthermore, stability of Sm—Fe—N hard magnetic materials is limited at temperature above 300° C. A significant enhancement of coercivity of Sm—Fe—N is observed with a refinement of the material's microstructure, including homogeneity both in composition and grain size distribution, as well as second phase effect.

The state-of-the-art of the process for rare earth iron nitride, or rare earth iron carbide, or rare earth iron hydride is to form rare earth iron alloy first followed by nitridation, carbonation and hydridation. The lattice constants increase about 6% percent after nitridation from $Sm_2Fe_{17}$ to $Sm_2Fe_{17}N_{2+\delta}$.

One way to fabrication of nitride materials is to use metal amides and derivatives. High purity and homogeneous nitride and carbonitride materials, such as aluminum nitride, titanium nitride, molybdenum carbonitride, have been synthesized by decomposition of polymerized amide precursors, such as $(R_2N)_3Al$, R(H)AlN(H)R, $Ti(NR_2)_n$, where R stands for alkyl groups.

The following seven (7) prior art references are found to be pertinent to the field of the present invention:

1. U.S. Pat. No. 5,137,587 issued to Schultz et al. on Aug. 11, 1992 for "Process For The Production Of Shaped Body From An Anisotropic Magnetic Material Based On The SM—FE—N System" (hereafter the "Schultz Patent");

2. U.S. Pat. No. 5,137,588 issued to Wecker et al. on Aug. 11, 1992 for "Process For The Production Of An Anisotropic Magnetic Material Based Upon The SM—FE—N System" (hereafter the "Wecker Patent");
3. U.S. Pat. No. 5,288,339 issued to Schnitzke et al. on Feb. 22, 1994 for "Process For The Production Of Magnetic Material Based On The SM—FE—N System" (hereafter the "Schnitzke Patent");
4. U.S. Pat. No. 5,665,177 issued to Fukuno et al. on Sep. 9, 1997 for "Method For Preparing Permanent Magnet Material, Chill Roll, Permanent Magnet Material, And Permanent Magnet Material Powder" (hereafter the "Fukuno Patent");
5. U.S. Pat. No. 5,720,828 issued to Strom-Olsen on Feb. 24, 1998 for "Permanent Magnet Material Containing A Rare-Earth Element, Iron, Nitrogen And Carbon" (hereafter the "Strom-Olsen Patent");
6. U.S. Pat. No. 5,788,782 issued to Kaneko et al. on Aug. 4, 1998 for "R—FE—B Permanent Magnet Materials And Process Of Producing The Same" (hereafter the "Kaneko Patent"); and
7. Journal Of Organometallic Chemistry 87 (1975) 301–309 (hereafter the "Journal").

The Schultz Patent discloses a process for the production of shaped body from an anisotropic magnetic material based on the Sm—Fe—N system. The system includes a crystalline, hard magnetic phase with a $Th_2Zn_{17}$ crystal structure, wherein N atoms are incorporated in the crystal lattice, is produced by compacting a powder Sm—Fe preliminary product with a Sm—Fe phase having a magnetically isotropic structure, followed by hot-shaping to provide an intermediate product with a Sm—Fe phase having a magnetically anisotropic structure, followed by heat treating the intermediate product in a nitrogen atmosphere to provide a Sm—Fe—N hard magnetic phase.

The Wecker Patent discloses a process for the production of an anisotropic magnetic material based upon the Sm—Fe—N system. The magnetic material of the Sm—Fe—N system includes a crystalline, hard magnetic phase with a $Th_2Zn_{17}$ crystal structure, wherein N atoms are incorporated in the crystal lattice, is produced. First a preliminary product is formed by sintering a Sm—Fe powder which is oriented in a magnetic field to provide a sintered body having a two-component Sm—Fe phase. The sintered body is heat treated in a nitrogen atmosphere to form the Sm—Fe—N hard magnetic phase.

The Schnitzke Patent discloses a process for the production of magnetic material based on the Sm—Fe—N system of elements. The magnetic material of the Sm—Fe—N system exhibits a crystalline hard magnetic phase with a $Th_2Zn_{17}$ crystal structure, wherein N atoms are incorporated in the crystal lattice. A preliminary product has a dual component $Sm_2Fe_{17}$ phase is produced by mechanical alloying followed by thermal treatment to achieve the desired microstructure. The preliminary product may also be obtained by a rapid-quenching technique.

The Fukuno Patent discloses a method for preparing permanent magnet material, chill roll, permanent magnet material, and permanent magnet material powder. A permanent magnet material is prepared by cooling with a chill roll a molten alloy containing R wherein R is at least one rare earth element inclusive of Y, Fe or Fe and Co, and B. The chill roll has a plurality of circumferentially extending grooves in a circumferential surface, the distance between two adjacent ones of the grooves at least in a region with which the molten alloy comes in contact being 100 to 300

μm average in an arbitrary cross section containing a roll axis. Permanent magnet material of stable performance is obtained since the variation of cooling rate caused by a change in the circumferential speed of the chill roll is small. The variation of cooling rate is small even when it is desired to change the thickness of the magnet by altering the circumferential speed. The equalized groove pitch results in a minimized variation in crystal grain diameter.

The Strom-Olsen Patent discloses a permanent magnet material containing a rare-earth element, iron, nitrogen and carbon. They are produced by gas absorbing nitrogen and carbon sequentially into a parent intermetallic compound. The resulting magnetic materials have high $T_C$, $\mu_o M_s$ and $\mu_o H_A$, are essentially free of α-Fe, and have a coercivity at 300° K. of at least 1.5 T. Anisotropic magnetic materials are produced by pretreating the intermetallic compound, which contains carbon, by powder sintering or oriented hot shaping, followed by nitriding and/or carbiding.

The Kaneko Patent discloses R—Fe—B permanent magnet materials having a good oxidation resistance and magnetic characteristics, and process of producing the same capable of pulverizing efficiently, whereby an R—Fe—B molten alloy having a specific composition is cast into a cast piece having a specific plate thickness and a structure, in which an R-rich phase is finely separated below 5 μm, by a strip casting process.

The Journal discloses a Ti(—NMe—$SiMe_2$—$SiMe_2$—MeN—)$_2$ (I) has been obtained from the reaction of $LiNMeSiMe_2NMeLi$ with $TiBr_4$. It forms yellow crystals of considerable stability which can be sublimed without decomposition. Its $^1$H NMR, IR and Raman spectra are reported. The crystal structure of I was determined by X-ray diffraction and was refined to R=0.059. The titanium atom in the spiro type molecule is tetrahedrally coordinated by nitrogen atoms with TiN distances of 1.905 Å SiN and SiSi distances in the slightly puckered five-membered rings are 1.733 and 2.355 Å, respectively.

It is desirable to provide a method for the production of magnetic material based on a substance system comprising a rare-earth element, iron, nitrogen and carbon. It is also desirable to provide a method for synthesis of magnetic material from rare-earth metal and iron amide and formation of magnetic materials by polymerizing, pyrolyzing and sintering amide precursor in an inert or reduced atmosphere.

SUMMARY OF THE INVENTION

The present invention is a novel method for synthesis of intermetallic substances containing iron, a rare earth element, nitrogen and/or carbon.

It is an object of the present invention to provide a method of fabricate rare earth iron nitride and carbonitride from polymerized metal amides and derivatives.

It is also an object of the present invention to provide intermetallic substances in the form of magnetic materials, including isotropic magnetic materials and aniostropic magnetic materials.

It is an additional object of the present invention to provide a method to fabricate rare earth iron nitride and carbonitride powder.

It is a further object of the present invention to provide a method for sintered magnetic articles.

The present invention method for fabrication of rare earth iron nitride and carbonitride magnetic powder as well as shaped magnets comprises the following basic steps:

(a) Synthesis of metal amide precursors:

(i) Synthesis of metal amide precursors via electrolysis in an organic electrolyte which containing alkylamine, acetonitrile, and tetrabutylammonium bromide salt; or (ii) Synthesis of metal amide precursors by reacting lithium dialkylamine with metal chloride, bromide or chloride-THF complex (THF=Tetrahydrofuran).

(b) Polymerization of metal alkylamides through partially aminolysis and condensation.

(c) Sintering of polymeric precursor to form magnetic materials in an inert or reduced atmosphere.

(i) Nitride and carbonitride magnetic powder. The powderized magnetic materials are formed through decomposition of polymeric precursor in an inert (nitrogen) or reduced atmosphere (ammonia).

(ii) Sintered nitride and carbonitride magnets. Fabrication of sintered nitride and carbonitride magnets is impossible via conventional process due to the limitation of the nitridation and carbonation. A novel approach to fabricate sintered rare earth iron nitride and carbonitride bulk magnet is invented. Shaped green body is formed first by pressing partially pyrolyzed polymerized powder, followed by sintering in an inert or reduced atmosphere under pressure.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
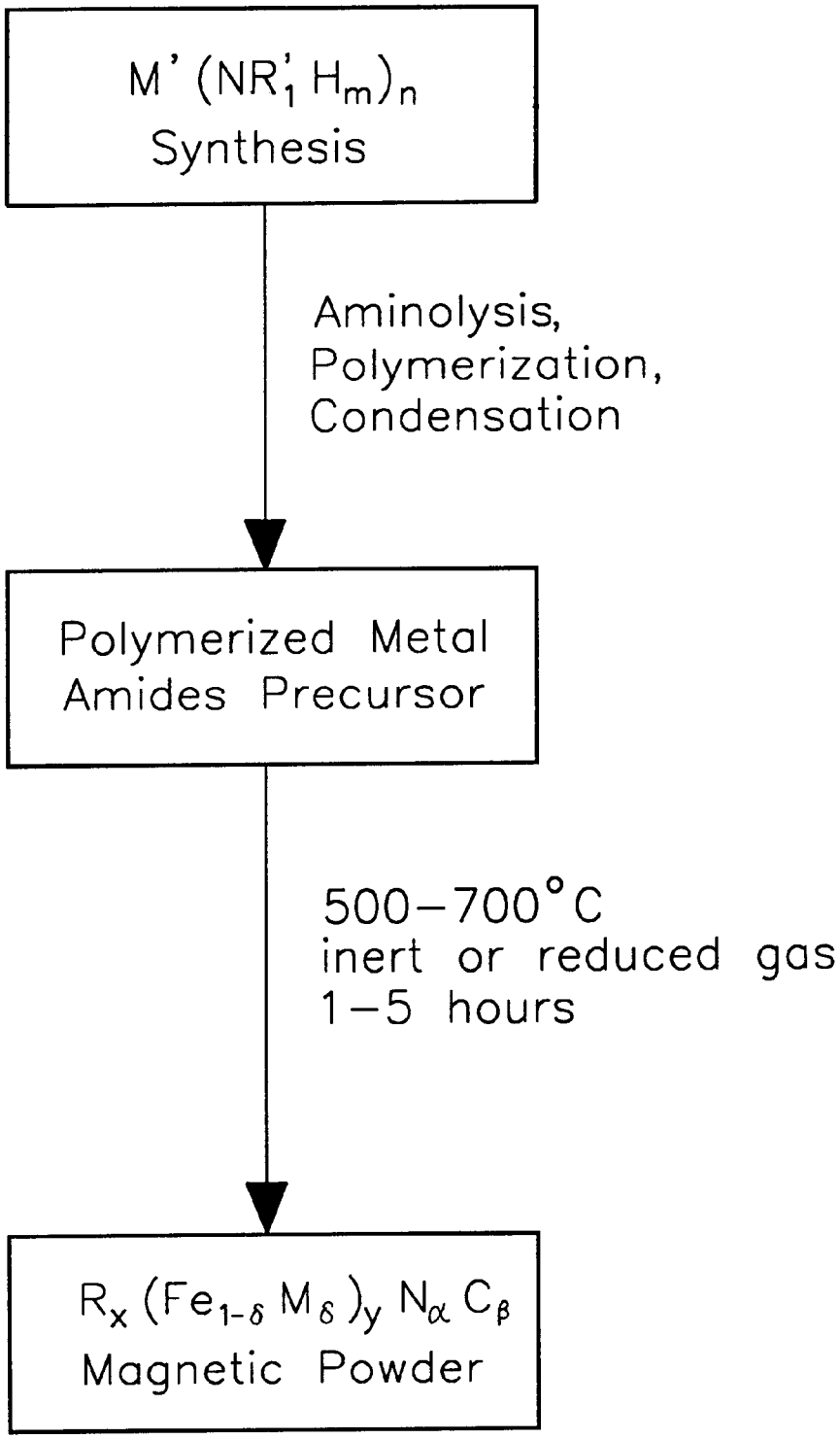
FIG. 1 is a block flow diagram illustrating synthesis of powderized $R_\chi(Fe_{1-\delta}M_\delta)_y N_\alpha C_\beta$ magnetic materials.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is directed to rare earth-iron nitride, and carbonitride magnetic materials and sintered magnets and a method for fabrication the same.

Rare earth iron nitride and carbonitride are produced by sintering polymerized amides in an inert or reduced atmosphere, i.e., sintering under the flow of nitrogen, argon, ammonia, CO or carbon hydride.

The amides are prepared in two methods. The first method is electrolysis and chemical reaction of lithium dialkylamine with metal (rare earth metal, iron and transition metal) chloride or bromide.

1. By Electrolysis

Metal alkylamides are synthesized by electrolysis of metal foils in an organic electrolyte. The electrolyte contains a primary amine, an aprotic solvent such as acetonitrile, and a tetraalkylammonium salt like tetrabutylammonium bromide. The salt is necessary as supporting electrolyte in order to increase the conductivity of the electrolyte solution. Tetrabutylammonium salts are readily dissolved in polar organic solvents and do not contaminate the final products with any cation impurities.

Metal foils are used as both anodes and cathodes. The reactor vessel is continuously flushed with nitrogen gas. A voltage is applied to the electrodes. Depending on the type of amines used in the electrolyte, the current density ranged from 5 to 20 $mA/cm^2$. The polarity of the DC voltage is reversed from time to time in order to achieve a uniform dissolution of both cathodes and anodes. Metal alkylamide, $M(NHR)_n$, is formed.

After the electrolysis reaction is stopped, the solution in the reactor is filtered and transferred into a gas-tight flask. A vacuum of about 10 mbar is attached to the flask. Polymerization is accelerated by heating up to 150° C.

2. Via Chemical Route

Variety of metal dialkylamides precursors can be synthesized through substitute reaction of metal chloride to lithium dialkylamide. The lithium dialkylamides are prepared by slowly adding LiBut into $HNR_2$ under the stirring in a solvent. The mixture is reflux under stirring and with ice cooling in the nitrogen atmosphere. The white precipitations of lithium dialkylamides are then obtained.

The metal chloride or bromide is then reacted with lithium dialkylamides in a mutual solvent to form the desired product. The product is then separated by centrifuge and the metal dialkylamide is further purified by vacuum distillation. Polymerization is accelerated by heating up to 150° C.

Figure 2:
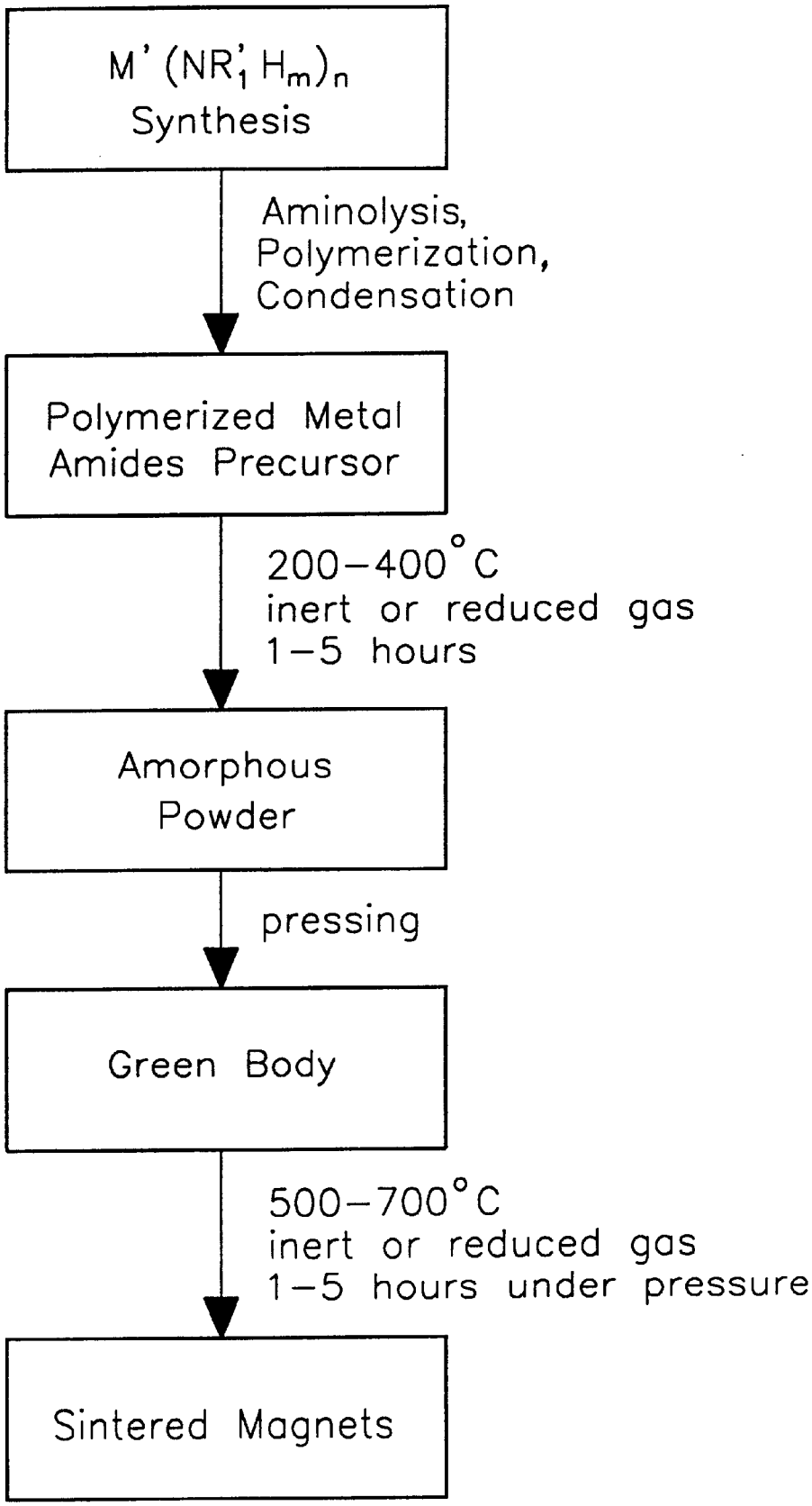
FIG. 2 is a block flow diagram illustrating synthesis of sintered $R_\chi(Fe_{1-\delta}M_\delta)_y N_\alpha C_\beta$ magnet.

The rare earth-iron nitride, and carbonitride powder is synthesized as indicated schematically in FIG. 1 and the sintered body of rare earth-iron nitride, and carbonitride magnetic is indicated schematically in FIG. 2.

EXAMPLE 1

$(Cy_2N)_3Sm(THF)$,toluene $SmCl_3(THF)_3$ reacted with anionic dialkylamides to give different products, depending on the nature of the alkyl groups. In order to fabricate non-chlorine samarium amides, cyclohexyl (Cy) group is chosen.

$SmCl_2(H_2O)_6$ are placed in a flask and under nitrogen are covered with a generous amount of TMSCl. The amount should be sufficient for covering the solid and form a liquid slurry. The mixture is refluxed and stirred overnight. The excess of TMSCl is removed and dry THF is added to the solid. The mixture is boiled for 2 hours and cooled in the freezer. The solid is collected under nitrogen and extracted in a Soxhlet filter using freshly distilled THF. When the extraction is finished, the suspension is cooled and then placed in the freezer overnight. The solid is collected, dried and stored in ampoules under nitrogen.

$Cy_2NLi$ is prepared under rigorous dry conditions by adding 1 equivalent of n-BuLi into dry $Cy_2NH$ in hexane, follows by bringing the mixture to the boiling point and then freezing it. A white crystalline solid is obtained. The product is air-sensitive and it is a tetramer.

$Cy_2NLi$ is added to a stirred solution of $SmCl_3(THF)_3$ at room temperature in THF (solution turns to pale yellow instantaneously). Removal of solvent is proceeded in vacuo. Residual crystalline solid is redissolved in toluene and LiCl is filtered out. The solution is kept at −30° C. for 2 days to get pale yellow single crystal of $[(Cy_2N)_3Sm(THF)]$toluene. The analysis via precipitation with $AgNO_3$ showed that chlorine content is much lower than 1%.

EXAMPLE 2

Synthesis of $[Fe(NCy_2)_2]_2$ n-BuLi solution in hexane is added dropwise to $HNCy_2$ in THF with cooling in an ice bath (Cy=cyclohexyl). $FeBr_2$ is added via a solid-addition funnel. The solution turned dark red-green is allowed to warm to room temperature and stir overnight. The volatiles are removed under reduced pressure, leaving a black-red residue. The residue is extracted several times with 30 ml of hot toluene, and the extract is than filtered. On cooling to room temperature, the dark red solution yielded dark red crystals of $[Fe(NCy_2)_2]_2$.

EXAMPLE 3

$[(Cy_2N)_3Sm(THF)]$toluene and $[Fe(NCy_2)_2]_2$ are mixed in the dry-box in the appropriate ratio and grind thoroughly using a mortar.

The mixture is heated to 150° C. under flow of nitrogen to further polymerize. The powder is obtained by sintering polymerized amides in an inert or reduced atmosphere to 550° C.

Defined in detail, the present invention is a method for producing a magnetically anisotropic magnetic material, the method comprising the steps of: (a) sintering a compacted powder or a sintered article having a main phase of formula: $R_\chi(Fe_{1-\delta}M_\delta)_yN_\alpha C_\beta$ wherein (b) R is at least one element selected from Nd, Pr, La, Ce, Tb, Dy, Ho, Er, Eu, Sm, Gd, Pm, Tm, Yb, Lu, and Y; (c) M is at least one element selected from Ti, V, Cr, Mn, Fe, Co, Ni, Zr, Nb, Mo, Hf, Ta, W, B, Al, Si, P, Ga, Ge, and As; (d) $\chi$ is 0.1–8.5; (e) y is 14–19; (f) $\delta$ is 0–0.95; (g) $\alpha$ is 0.05–4; and (h) $\beta$ is 0–4.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A method for producing a magnetically anisotropic magnetic material, the method comprising the steps of:

a. synthesizing metal amides;

b. aminolyzing, polymerizing and condensing said metal amides to produce polymerized metal amides precursor; and c. heating said polymerized metal amides precursor at a temperature within the range of 500° C. to 700° C. in an inert or reduced atmosphere for a period of time between 1 to 5 hours to produce magnetic powder having a main phase of formula:

$$R_\chi(Fe_{1-\delta}M_\delta)_yN_\alpha C_\beta$$

wherein

R is at least one element selected from Nd, Pr, La, Ce, Th, Dy, Ho, Er, Eu, Sm, Gd, Pm, Tm, Yb, Lu, and Y;

M is at least one element selected from Ti, V, Cr, Mn, Fe, Co, Ni, Zr, Nb, Mo, Hf, Ta, W, B, Al, Si, P, Ga, Ge, and As;

$\chi$ is 0.1–8.5;

y is 14–19;

$\delta$ is 0–0.95;

$\alpha$ is 0.05–4; and $\beta$ is 0–4.

2. The method in accordance with claim 1, wherein said inert atmosphere is vacuum.

3. The method in accordance with claim 1, wherein said inert atmosphere is nitrogen.

4. The method in accordance with claim 1, wherein said inert atmosphere is argon.

5. The method in accordance with claim 1, wherein said reduced atmosphere is ammonia.

6. A method for producing a magnetically anisotropic magnetic material, the method comprising the steps of:

a. synthesizing metal amides;

b. aminolyzing, polymerizing and condensing said metal amides to produce polymerized metal amides precursor; and c. heating said polymerized metal amides precursor at a temperature within the range of 200° C. to 400° C. in an inert or reduced atmosphere for a period of time between 1 to 5 hours to produce amorphous powder;

d. pressing said amorphous powder into a polymerized green body;

e. heating said polymerized green body at a temperature within the range of 500° C. to 700° C. in an inert or reduced atmosphere for a period of time between 1 to 5 hours to produce a shaped magnet having a main phase of formula:

$$R_{\chi}(Fe_{1-\delta}M_{\delta})_{y}N_{\alpha}C_{\beta}$$

wherein

R is at least one element selected from Nd, Pr, La, Ce, Tb, Dy, Ho, Er, Eu, Sm, Gd, Pm, Tm, Yb, Lu, and Y;

M is at least one element selected from Ti, V, Cr, Mn, Fe, Co, Ni, Zr, Nb, Mo, Hf, Ta, W, B, Al, Si, P, Ga, Ge, and As;

$\chi$ is 0.1–8.5;

y is 14–19;

$\delta$ is 0–0.95;

$\alpha$ is 0.05–4; and $\beta$ is 0–4.

7. The method in accordance with claim 6, wherein said inert atmosphere is vacuum.

8. The method in accordance with claim 6, wherein said inert atmosphere is nitrogen.

9. The method in accordance with claim 6, wherein said inert atmosphere is argon.

10. The method in accordance with claim 6, wherein said reduced atmosphere is ammonia.

* * * * *